United States Patent [19]

Ross

[11] 4,159,004

[45] Jun. 26, 1979

[54] WORK FEEDING MECHANISM FOR SEWING MACHINES

[75] Inventor: Roger J. Ross, Mont St-Gregoire, Canada

[73] Assignee: The Singer Company, New York, N.Y.

[21] Appl. No.: 901,361

[22] Filed: Apr. 28, 1978

[51] Int. Cl.[2] ..... D05B 27/02

[52] U.S. Cl. ..... 112/314; 112/215

[58] Field of Search ..... 112/215, 210, 209

[56] References Cited

U.S. PATENT DOCUMENTS

| | | | |
|---|---|---|---|
| 134,101 | 12/1872 | Rice | |
| 218,413 | 8/1979 | Willcox | |
| 345,801 | 7/1886 | Palmer | |
| 396,630 | 1/1889 | Wardwell, Jr. | |
| 497,645 | 5/1893 | Flanagan | 112/215 |
| 1,085,401 | 1/1914 | Bulasky | |
| 1,252,666 | 1/1918 | Corrall et al. | 112/210 |
| 2,137,857 | 11/1938 | Robert | 112/210 |
| 2,160,120 | 5/1939 | Brussel | 112/216 |
| 2,749,859 | 6/1956 | Saver | 112/210 |
| 3,527,183 | 9/1970 | Szostak et al. | 112/215 |
| 3,921,552 | 11/1975 | Daman et al. | 112/215 |

FOREIGN PATENT DOCUMENTS 49-90354 8/1974 Japan.

*Primary Examiner*—Wm. Carter Reynolds

*Attorney, Agent, or Firm*—Michael H. Wallach; Robert E. Smith; Edward L. Bell

[57] ABSTRACT

A sewing machine work feeding mechanism of the drop feed variety having a feed dog adjustably supported at one end of an elongated feed bar. The pivot end of the feed bar is supported between a pair of pintles by a trunnion pin. The trunnion pin is journalled in a threaded pivot pin which is supported within the feed bar by a threaded sleeve which is free to rotate within the pivoted end of the feed bar. The inclination of the feed dog with respect to the throat plate may be adjusted by turning the threaded sleeve against the threaded pivot pin, thereby changing the height of the feed bar with respect to the plane of the support pintles. The feed dog is attached to the feed bar by a feed dog carrier and a threaded stud which permits the height of the feed dog carrier to be adjusted relative to the feed bar, thereby allowing independent adjustment of the height of the feed dog above the throat plate.

7 Claims, 5 Drawing Figures

48
42
46
38
60
58
34
44
50
62
98
82
83
96
114
92
84
94
100
74
72
70
68
80
76
75
78
88
86
90
142
140
138
116
118
132
136
134
14
120
130
128
124
122
126
30
36
32
5
52
54
40

WORK FEEDING MECHANISM FOR SEWING MACHINES

BACKGROUND OF THE INVENTION

1. Field of the Invention

This invention relates to sewing machines in general and more particularly to sewing machines having work feeding mechanisms of the drop feed variety in which the work engaging feed dog engages the work piece during the feed advance cycle and drops out of engagement with the work piece during the return cycle.

2. Description of the Prior Art

In a work feeding mechanism of the drop feed variety it is important that the feed bar supporting the feed dog be maintained parallel to the throat plate to insure that work fed by the feed dog will not drift toward the right or left side of the line of feed. It is also important for accurate stitch formation that the feed dog be centered within the feed dog accommodating slots in the throat plate and that it be adjusted to a correct elevation above the throat plate. One prior known work feeding mechanism employed a feed bar which supported a feed dog at one end and whose second end was suspended from the sewing machine bed by an adjustable pivot. The adjustable pivot permitted the feed dog to be laterally adjusted in the feed dog accommodating slots of the throat plate. See for example U.S. Pat. No. 3,527,183 to Szostak et al. A problem associated with prior art work feeding mechanisms such as that disclosed in U.S. Pat. No. 3,527,183 is the inability to independently adjust the centering, leveling and elevation of the feed dog while the work feeding mechanism is installed in a sewing machine.

SUMMARY OF THE INVENTION

It is an object of this invention to provide an improved work feeding mechanism in which the inclination of the feed dog with respect to the throat plate may be easily adjusted.

It is also an object of this invention to provide a means for adjusting the height of the feed dog with respect to the throat plate independent of adjustments made at the pivoted extremity of the feed bar.

It is another object of this invention to provide a work feeding mechanism in which the lateral position of the feed dog with respect to the throat plate slots may be easily adjusted.

The above and other objects are achieved by providing a bore in the pivoted extremity of a feed bar in which is seated an internally threaded sleeve which is free to rotate therein. A pivot pin having a threaded body is formed with a head having a bore passing therethrough. The threaded body of the pivot pin is threaded into the sleeve. The bore in the head of the pivot pin receives a trunnion pin which eccentrically supports the pivoted extremity of the feed bar between two support pintles, thereby allowing the feed bar to oscillate about the pintles.

A locking collar is attached to one end of the threaded sleeve with a set screw to facilitate rotation of the sleeve within the bore of the feed bar. The distance between the pivot axis of the support pintles and the horizontal plane of the feed bar may be varied by rotating the threaded sleeve about the pivot pin, thereby changing the inclination of the feed dog with respect to the throat plate.

The extremity of the elongated feed bar to which the feed dog is attached contains a threaded bore whose axis is perpendicular to the throat plate. A feed dog carrier having an upper and a lower support ear is attached to the feed bar by a threaded stud which is restrained in the lower support ear and which is threaded into the bore of the feed bar. The vertical distance between the feed bar and the support ears may be varied by rotating the threaded stud within the bore of the feed bar, thereby effecting a change in the height above the throat plate that the feed dog will be driven.

BRIEF DESCRIPTION OF THE DRAWINGS

The above and other objects of the invention will be evident from an understanding of the preferred embodiment which is set forth in such detail as to enable those skilled in the art to readily understand the function, operation, construction, and advantages of it when read in conjunction with the accompanying drawings in which.

DESCRIPTION OF THE PREFERRED EMBODIMENT

Figure 1:
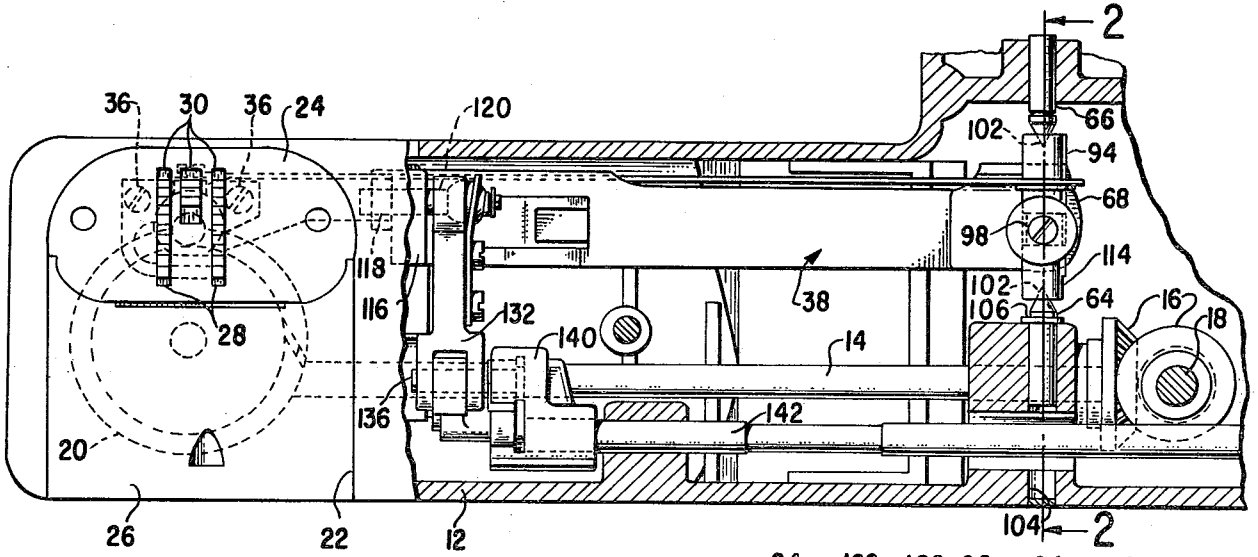
FIG. 1 is an elevational view of a portion of the bed of a sewing machine with a portion broken away to expose the invention applied to the work feed mechanism.

Referring particularly to FIG. 1, the work supporting bed portion of a sewing machine frame is indicated at 12. A bed shaft 14 is journalled lengthwise in the bed and is driven by a set of bevel gears 16 from a vertical shaft 18. A loop taker 20 is driven from the bed shaft 14. The top surface of the work supporting bed 12 above the loop taker 20 is formed with an access opening 22 which has a throat plate 24 and a retractable slide cover plate 26 enclosing the opening. The throat plate 24 contains a set of feed dog accommodating slots 28 through which the serrated work engaging teeth 30 of a feed dog 32 move to effect the movement of a work piece across the work supporting bed.

Figures 3, 4, 5:
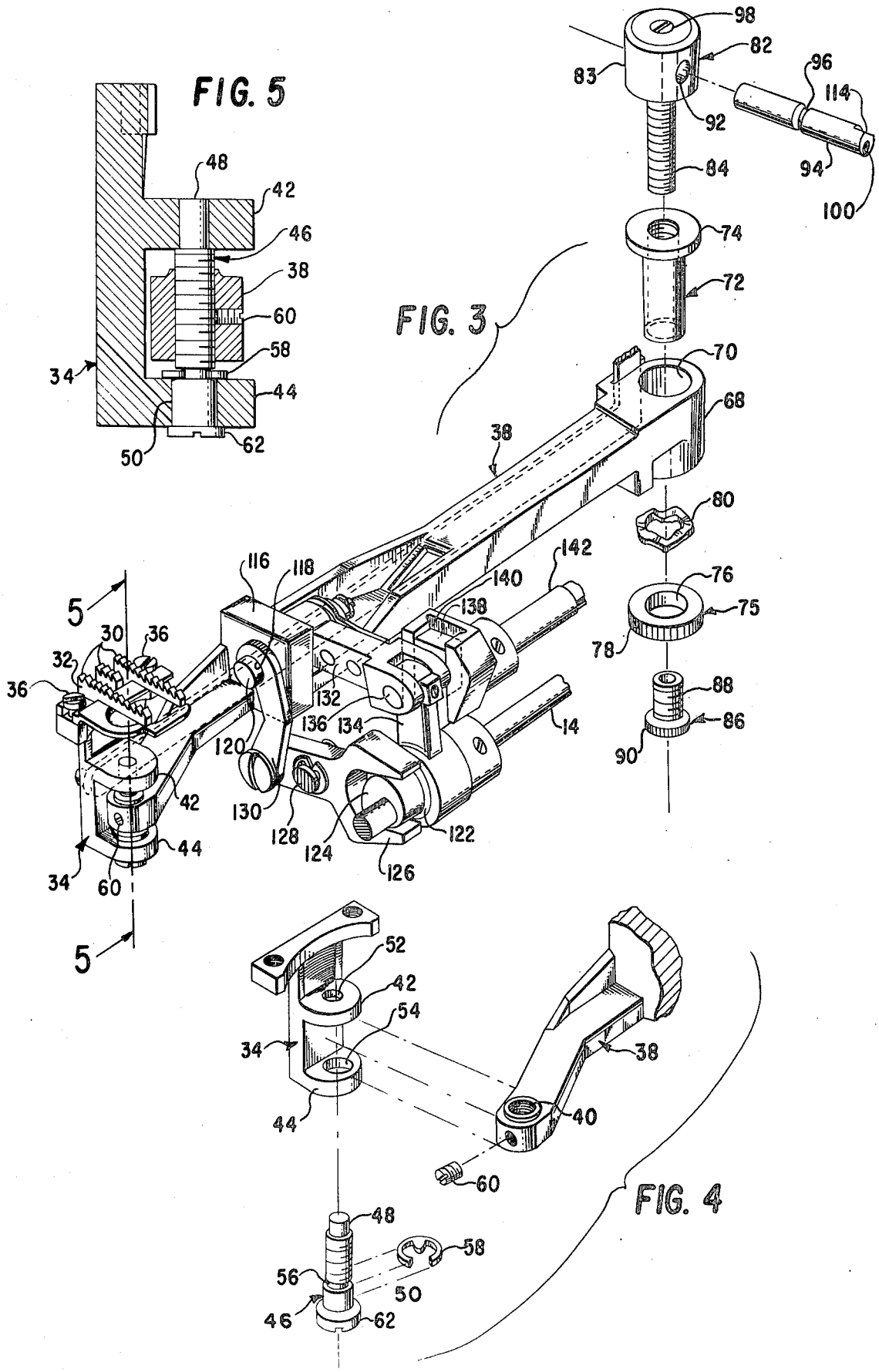
FIG. 3 is a perspective view of the work feed mechanism removed from the sewing machine showing the pivot mechanism and the adjustable feed dog carrier of the invention.
FIG. 4 is a perspective view of one end of a feed bar having a feed dog carrier and adjusting means constructed in accordance with the teachings of this invention attached thereto.
FIG. 5 is a cross sectional view taken substantially along line 5—5 of FIG. 3 showing the feed dog carrier attached to the feed bar with an adjusting stud.

As best shown in FIGS. 3 and 4, the feed dog 32 is attached to a feed dog carrier 34 by conventional fasteners such as the screws 36. The feed dog extremity of an elongated feed bar 38 contains a threaded bore 40 whose axis is substantially perpendicular to the plane of the throat plate 24. The feed dog carrier 34 has a body which has preferably formed thereon an upper feed dog carrier support ear 42 which overlies the top of the feed bar 38 and a lower feed dog carrier support ear 44 which overlies the bottom of the feed bar 38, the ears 42 and 44 extending perpendicularly from the body of the feed dog carrier 34. The feed dog carrier 34 is attached to the feed bar 38 by a vertical adjustment means comprising a threaded stud 46 having an upper cylindrical portion 48 and a lower cylindrical portion 50 which engage the mounting ears 42 and 44 and which is threaded into the threaded bore 40 in the feed bar 38. The diameter of the upper cylindrical portion 48 of the threaded stud 46 is small enough to be rotatably received within an aperture 52 having an axis formed in the upper support ear 42 and the diameter of the lower cylindrical portion 50 is small enough to be rotatably received within an aperture 54 having an axis formed in the lower support ear 44. The axis of the aperture 52 and the axis of the aperture 54 are coincident with the axis of the threaded aperture 40, thereby allowing the carrier 34 to freely pivot about the stud 50. An annular groove 56 is formed on the threaded stud 46 to receive a retainer means, such as a clip 58 to retain the threaded stud to the feed dog carrier 34. A locking means, shown in the preferred embodiment as a set screw 60, may be used to fixedly restrain the threaded stud 46 from rotary motion within the bore 40. The threaded stud 46 has an adjusting head, shown in the preferred embodiment as a slotted head 62, formed at one end thereof to facilitate rotation of the threaded stud 46 within the feed bar 38.

FIG. 1 shows that the feed bar 38 extends lengthwise along the sewing machine bed 12 in a direction substantially perpendicular to the work feeding direction, and is pivotally supported from the bed 12 at the extremity opposite the feed dog 32 by a pivot means shown preferably as a pair of pintles indicated at 64 and 66. The feed bar 38 has contained on the pivotal extremity thereof an orthogonal pivot means about which the feed bar may oscillate, thereby allowing for compound motion of the feed dog 32 in both the horizontal and vertical planes.

Figure 2:
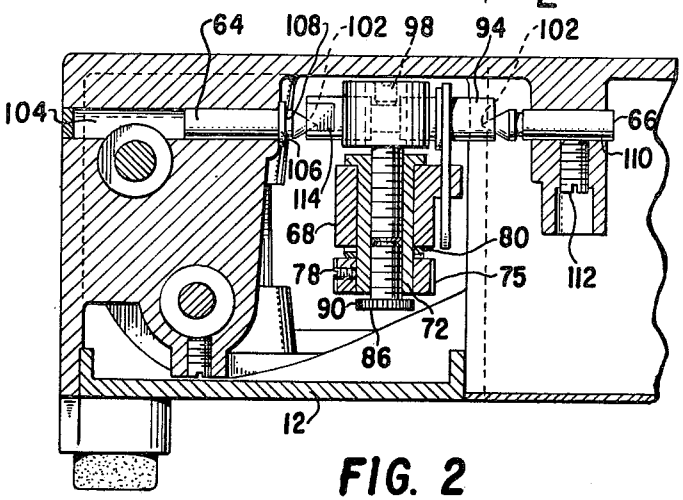
FIG. 2 is an enlarged cross sectional view taken substantially along line 2—2 of FIG. 1.

The orthogonal pivot means contained on the pivoted extremity of the feed bar 38 is more particularly formed with a boss 68 which has a bore 70 contained therethrough. The bore 70 is adapted to receive an internally threaded sleeve 72 so that the sleeve may be free to rotate therein. One end of the sleeve 72 has a shoulder 74 formed thereon for retaining the sleeve 72 within the bore 70. FIG. 2 shows the sleeve 72 preferably extending through the bore 70 and beyond the lower surface of the boss 68. A locking collar 75 containing an aperture 76 to receive the end of the sleeve 72 is fastened to the lower end of the sleeve 72 with a conventional fastener means preferably shown as a set screw 78. A wavy washer 80 may be placed on the sleeve 72 between the locking collar 75 and the boss 68 to facilitate the free rotation of the sleeve 72 within the boss 68.

The pivoted extremity of the elongated feed bar 38 is suspended from the bed 12 of the sewing machine by a pivot pin 82 journalled in the feed bar 38 which has a threaded portion 84 which engages the internal threads contained in the sleeve 72. The pivot pin 82 defines an axis of turning movement of the feed bar 38 which is perpendicular to the work supporting surface of the bed 12. FIGS. 2 and 3 best illustrate a threaded insert 86 which has a threaded body 88 and a knurled adjusting head 90. The threaded body 88 is adapted to engage the threads contained on the interior of the threaded sleeve 72. One end of the threaded insert 86 is designed to abut against the end of the threaded portion 84 of the pivot pin 82 to lock the pivot pin 82 within the threaded sleeve 72. The knurled adjusting head 90 may be used to conveniently grip the threaded insert 86 so that it may be loosened or tightened against the end of the threaded portion of the pivot pin 82.

The pivot pin 82 is formed with an enlarged head 83 having a bore 92 contained therethrough. Journalled within the bore 92 in the head 83 of the pivot pin 82 is a trunnion pin 94 which defines an axis of turning movement of the feed bar 38 parallel to the direction of work feed. The trunnion pin 94 contains an annular groove 96 which is engaged by a set screw 98 contained in the head of the pivot pin 82 to restrain the pivot pin from movement along the length of the trunnion pin 94. The trunnion pin also contains a conical seat 100 at either end thereof which are disposed eccentrically of the axis of the trunnion pin 94. The conical seats 100 receive a pair of conical heads 102 formed at the ends of the pintles 64 and 66 which comprise a pivotal support for the trunnion pin 94. One conical seat 100 on one end of the trunnion pin 94 is engaged by the head of the conical pintle 64 slidably contained within a bore 104 in the bed. The pintle 64 is retained against a stop formed by a snap ring 106 contained in an annular groove 108 in the pintle 64. The conical seat 100 on the other end of the trunnion pin 94 is engaged by the head of the pintle 66 contained in a bore 110 in the sewing machine bed 12 and retained therein by a conventional fastener means such as a set screw 112. The trunnion pin 94 preferably has a flat surface 114 formed thereon which may be engaged by a wrench or the like to permit the trunnion pin 94 to be rotated within the pivot pin 82 upon the loosening of the set screw 98 contained in the pivot pin head 83 to selectively impart to the feed bar 38 an adjustment component in a direction perpendicular to the work feeding direction. The lateral position of the feed dog 32 may thereby be adjusted with respect to the length of the bed by virtue of the eccentricity of the pintle seats 100, thereby allowing the alignment of the rows of teeth in the feed dog accommodating slots 28 of the throat plate 24.

The inclination of the feed bar 38 with respect to the sewing machine throat plate 24 may be varied toward and away from the work supporting surface of the bed 12 by adjusting the distance separating the feed bar 38 from the axis of the conical support pintles 64 and 66. The adjustment is effected by backing off the threaded insert 86 from contact with the threaded portion 84 of the pivot pin and then rotating the locking collar 75 which causes the threaded sleeve 72 to freely rotate within the boss 68 and about the pivot pin 82. The feed bar 38 is thereby made to translate along the length of the threaded pivot pin 82, thus changing the distance of the feed bar 38 with respect to the pivot axis defined by the trunnion pin 94 and supporting pintles 64 and 66. The pivot pin 82 may thereafter be locked against rotation within the threaded sleeve 72 by rotating the threaded insert 86 within the threaded sleeve 72 until the end thereof abuts against the end of the pivot pin 82. The change in distance between the pivot axis and the feed bar 38 produces a corresponding change in the inclination of the feed bar 38 with respect to the throat plate 24. It will thereby be apparent that a change in the inclination of the feed bar 38 will change the angle of inclination of the rows of serrated work engaging teeth of the feed dog 32 with respect to the throat plate 24. It will be appreciated that the direction of motion imparted to the work piece by the feed advance motion of the feed dog 32 is dependent on the inclination of the feed dog 32 with respect to the throat plate 24. By adjusting the distance between the pivot axis and the feed bar 38, the serrated work engaging teeth 30 of the feed dog 32 can be made parallel to the plane of the throat plate 24 and the resulting transport of the work piece will occur in a substantially straight line transversely across the work supporting bed 12 of the sewing machine.

It will also be appreciated that the height of travel of the feed dog 32 above the throat plate 24 may be adjusted by rotating the threaded stud 46 within the threaded bore 40 of the feed bar 38, thereby causing the distance between the feed bar 38 and the feed dog carrier 34 to change. Once the correct setting has been obtained by translation of the feed bar along the threaded portion of the stud 46, the locking means 60 may be employed to secure the proper height adjustment. The operation of the work feeding mechanism will, by virtue of the three adjustments herein described, produce a straight feed of the work piece across the bed 12 of the sewing machine.

The feed dog 32 is driven by a work feeding mechanism which provides motion to the feed dog 32 both along the line of feed as well as elevating the feed dog 32 up through the throat plate during the work feeding stroke, and drops the feed dog 32 beneath the level of the throat plate 24 during the return stroke of the feed dog 32.

The work feeding driving connections consist of a block 116 formed on the feed bar 38 and extending transversely thereof. The block 116 contains a bore 118 in which is freely journalled a pin 120 through which motion is imparted to the feed dog 32. A feed advance eccentric 122 and a feed lift cam 124 are driven by the bed shaft 14 for imparting motion to the feed dog 32.

Lift at the beginning of the work feed stroke and drop of the feed dog 32 on the return stroke are provided by having the feed lift cam 124 connected to a bifurcated extremity of a lever 126 which is fulcrummed on a stud 128 fixedly attached to the sewing machine bed 12. The lever 126 is pivotally connected to a lever 130 which is connected to the pin 120 in the block 116. Rotation of the bed shaft 14 thereby produces a lift and drop stroke of the feed dog 32.

The work feed and return stroke of the feed dog 32 is provided by connecting the feed advance eccentric 122 to a link 132 through a pitman 134 and the link 132 is connected to the pin 120 on the side of the block 116 opposite from the lever 130. A pivot pin 136 forms a pivotal connection between the link 132 and the pitman 134 which is oscillated in response to rotation of the feed advance eccentric 122. A slide block 138 is journalled on the pivot pin 136 and constrained in a guide slot formed in a feed block 140 which is attached to a rock shaft 142. The angular position of the rock shaft 142 dictates the feed advance movement imparted to the feed dog 32 by controlling the oscillatory movement of the slide block 138. A more complete description of the motion imparted to the feed dog 32 by the work feeding mechanism may be had by reference to U.S. Pat. No. 3,527,183 which issued to Szostak et al on Sept. 8, 1970 and which is owned by the assignee of this invention.

Modifications and variations of the above described preferred embodiment may become evident to one skilled in the art in light of the above teachings. It is to be understood that variations may be made to the preferred embodiment without departing from the spirit and scope of the invention as defined in the appended claims.

Having thus set forth the nature of the invention, what is claimed herein is:

1. An improved work feeding mechanism for a sewing machine having a bed with a work supporting surface contained thereon for feeding a work piece in a direction transversely across said work supporting surface, said work feeding mechanism including an elongated feed bar extending in the bed substantially perpendicular to the work feeding direction, driving connections to said feed bar for imparting work feed movements thereto, a feed dog, a feed dog carrier means pivotally supporting said feed dog on a first extremity of said feed bar, and orthogonal pivot means arranged at the second extremity of said feed bar, said orthogonal pivot means including a pivot pin journalled in said feed bar and defining one axis of turning movement of said feed bar perpendicular to the work supporting surface of said bed, a trunnion pin carried transversely in said pivot pin and defining another axis of turning movement of said feed bar parallel to said direction of work feed, and means for supporting said trunnion pin beneath said bed, wherein the improvement comprises means for selectively positioning said feed dog carrier means relatively to said first extremity of said elongated feed bar to effect vertical adjustment of said feed dog relatively to the work supporting surface of said bed, and means for selectively adjusting the second extremity of said feed bar toward and away from said work supporting surface of said bed including a sleeve having a set of internal threads, said sleeve threadedly engaging said pivot pin, means for rotatably constraining said sleeve in place in the second extremity of said feed bar, and means for locking said sleeve to said pivot pin in selected position of threaded engagement thereon.

2. The arrangement as set forth in claim 1 wherein said means for supporting said trunnion pin of said orthogonal pivot means beneath said bed comprises a pivotal support for said trunnion pin arranged eccentrically relatively to said bed for selectively imparting to said feed bar an adjustment component in a direction perpendicular to the work feeding direction.

3. The arrangement as set forth in claim 1 wherein said means for locking said sleeve to said pivot pin is selected position of threaded engagement thereon comprises a threaded insert having a threaded body and a knurled adjusting head formed at the lower end of said body, said threaded body engaging said internal threads contained within said threaded sleeve and adapted to abut against said pivot pin when said knurled adjusting head is rotated, thereby restraining said pivot pin from rotation relative to said threaded sleeve.

4. The arrangement as set forth in claim 1 wherein said means for rotatably constraining said sleeve in place in said second extremity of said feed bar is a locking collar fastened at the lower end thereof, said locking collar facilitating rotation of said sleeve about said pivot pin.

5. The arrangement as set forth in claim 1 wherein said feed dog carrier means comprises a body having an upper feed dog carrier support ear formed substantially perpendicular to said body and overlying the top of said elongated feed bar, and a lower feed dog carrier support ear formed substantially perpendicular to said body and overlying the bottom of said elongated feed bar, said upper and said lower support ears having apertures formed therethrough, the axes of said apertures being coincident with the axis of a threaded bore contained in said first extremity of said elongated feed bar when said feed dog carrier means is pivotally attached to said elongated feed bar.

6. The arrangement as set forth in claim 1 wherein said means for selectively positioning said feed dog carrier means relatively to said first extremity of said elongated feed bar comprises a threaded stud having an adjusting head at one end thereof, a first cylindrical portion rotatably contained within said aperture of said upper support ear of said feed dog carrier, a second cylindrical portion rotatably contained within said aperture of said lower support ear, a threaded portion on said threaded stud, said threaded portion being threadedly engaged in a threaded bore contained on said first extremity of said elongated feed bar, and retainer means to retain said threaded stud to said feed dog carrier, whereby rotation of said adjusting head causes said elongated feed bar to translate along said threaded portion of said threaded stud and between said upper feed dog carrier support ear and said lower feed dog carrier support ear.

7. The arrangement as set forth in claim 6 wherein said retainer means comprises an annular groove disposed about the circumference of said threaded stud a distance above said adjusting head sufficient to contain the body of said lower support ear, and a clip engaging said annular groove and rotatably retaining said threaded stud within said aperture of said lower support ear.

* * * * *